US006612550B2

(12) United States Patent
Foot

(10) Patent No.: US 6,612,550 B2
(45) Date of Patent: Sep. 2, 2003

(54) FENCE POST

(76) Inventor: Calvin Douglas Foot, Box 8, Red Willow, Alberta (CA), T0B 3V0

( * ) Notice: Subject to any disclaimer, the term of this patent is extended or adjusted under 35 U.S.C. 154(b) by 61 days.

(21) Appl. No.: 09/995,127

(22) Filed: Nov. 27, 2001

(65) Prior Publication Data

US 2002/0056833 A1 May 16, 2002

(51) Int. Cl.[7] ..... E04H 17/20
(52) U.S. Cl. ..... 256/1; 256/12.5; 405/52; 405/21; 405/13
(58) Field of Search ..... 256/1, 12.5, 23, 256/19, 13; 405/52, 21, 63

(56) References Cited

U.S. PATENT DOCUMENTS 4,089,179 A * 5/1978 Trautman ..... 256/12.5 X
4,738,563 A 4/1988 Clark
2002/0172560 A1 * 11/2002 Dreyer ..... 405/63
2003/0044233 A1 * 3/2003 Hillard et al. ..... 405/21

* cited by examiner

*Primary Examiner*—Lynne H. Browne
*Assistant Examiner*—John R. Cottingham
(74) *Attorney, Agent, or Firm*—Davis & Bujold, P.L.L.C.

(57) ABSTRACT

A fence post includes a weighted base and a vertical member. The vertical member has a first end and a second end. The first end is secured to and extends substantially vertically from the weighted base. A float is provided that is axially movable along the vertical member from the first end toward the second end. A stop is spaced from the first end to limit travel of the float along the vertical member. This fence post is suited for use in wet areas, as it floats with the weighted base keeping the fence post in a stable upright condition.

5 Claims, 3 Drawing Sheets

FENCE POST

FIELD OF THE INVENTION

The present invention relates to a fence post and, in particular, a fence post for use in wetlands.

BACKGROUND OF THE INVENTION

Low lying wetlands have some areas that remain under water all year round and other areas that are under water for at least a portion of the year. The present method of fencing wetlands involves positioning fencing around bodies of water that are expected to remain all year round and permitting fencing to cut across those areas that are under water for only a portion of the year. Fencing around a body of water requires substantially more lineal feet of fencing. It also may deprive livestock of access to the body of water or grass surrounding the body of water.

SUMMARY OF THE INVENTION

What is required is a fence post that can be used to cut across wetlands, even wetlands that remain under water all year round.

According to the present invention there is provided a fence post which includes a weighted base and a vertical member. The vertical member has a first end and a second end. The first end is secured to and extends substantially vertically from the weighted base. A float is provided that is axially movable along the vertical member from the first end toward the second end. A stop is spaced from the first end to limit travel of the float along the vertical member.

The weighted base of the fence post, as described above, rests upon the ground in the dry season. As the water level rises, the float starts to rise up the vertical member, until the stop is reached. If the water continues to rise after the float reaches the stop, the fence post is lifted off the ground by the float. The weighted base, keeps the fence post in a stable upright condition when floating so it does not tip over. When the water level recedes, the weighted base of the fence post is set back down onto the ground. As the water level continues to recede, the float moves axially back down toward the first end of the vertical member.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
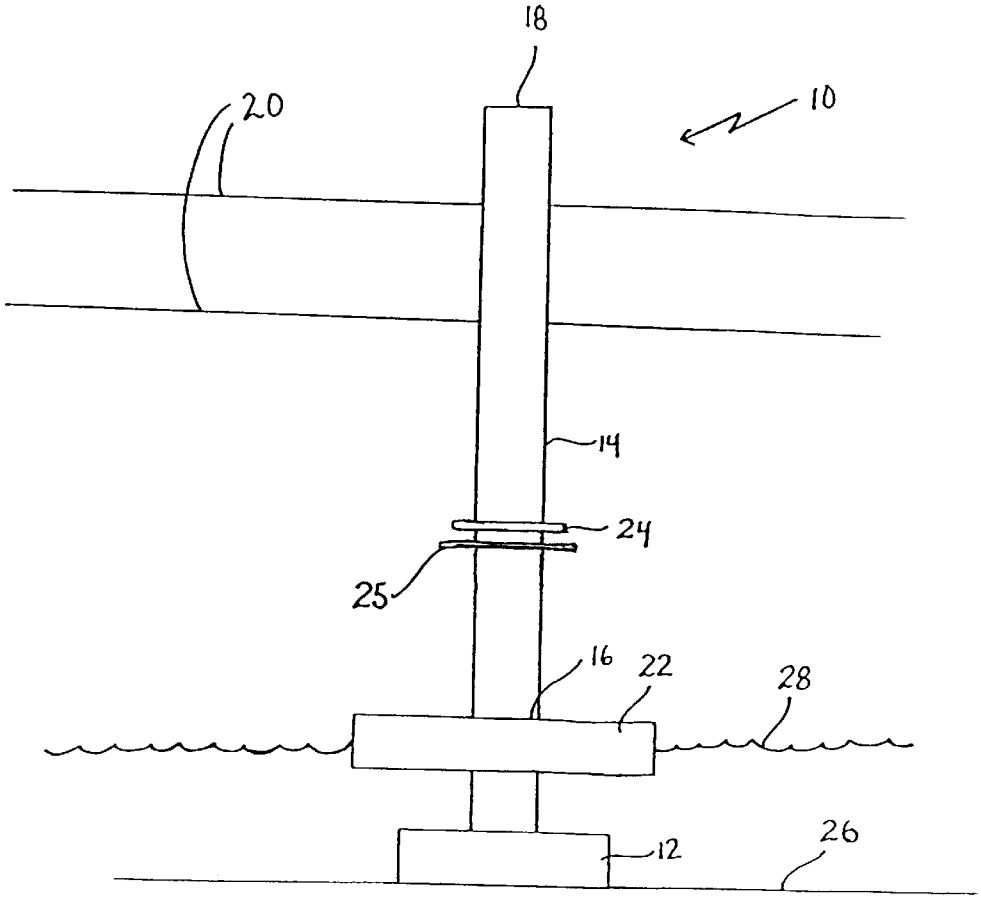
FIG. 1 is a side elevation view of a fence post constructed according to the teachings of the present invention, positioned in wetlands.

The preferred embodiment, a fence post generally identified by reference numeral 10, will now be described with reference to FIGS. 1 through 3.

Structure and Relationship of Parts:

Referring to FIG. 1, there is illustrated a fence post 10 which has a weighted concrete base 12 and a polymer plastic vertical member 14. Vertical member 14 has a first end 16 and a second end 18 with first end 16 being secured to and extending substantially vertically from weighted base 12.

Figure 2:
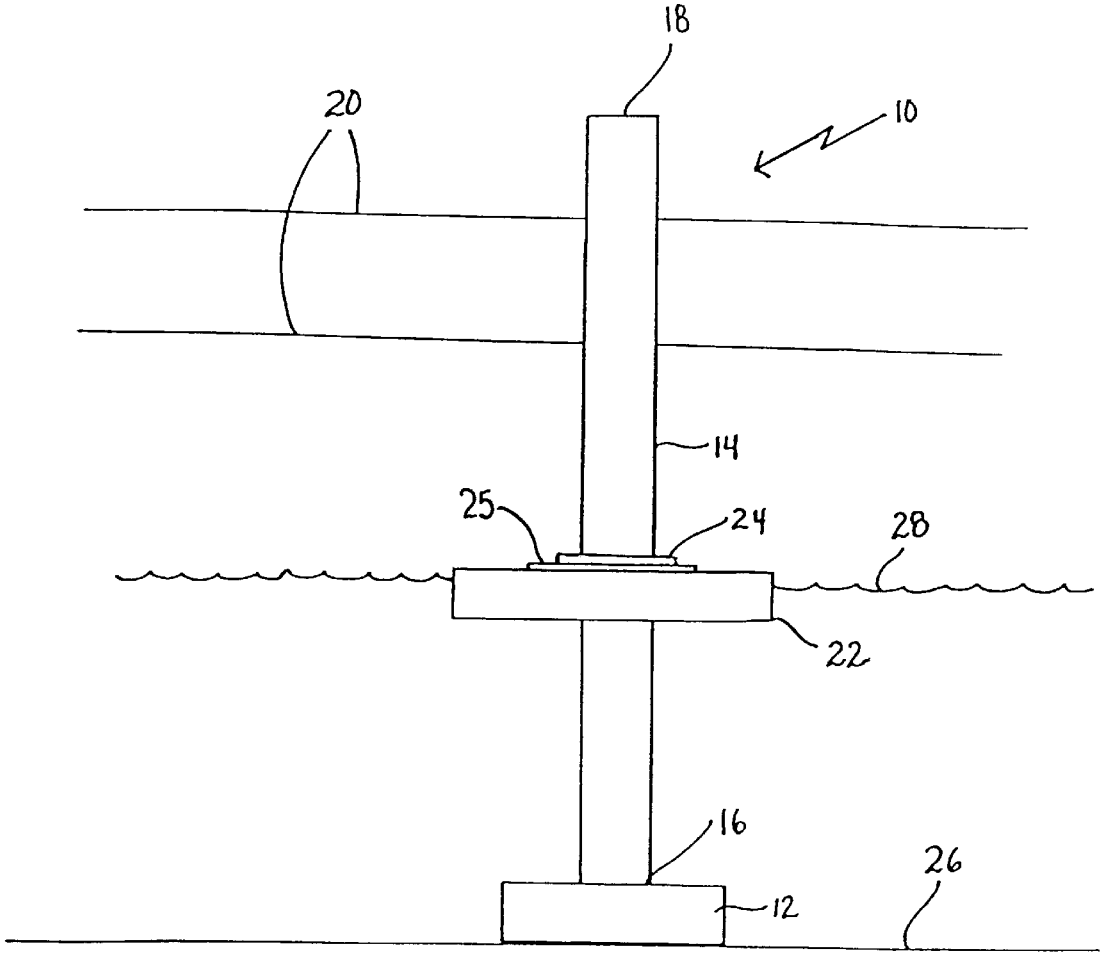
FIG. 2 is a side elevation view of the fence post illustrated in FIG. 1, as the water level rises.
Figure 3:
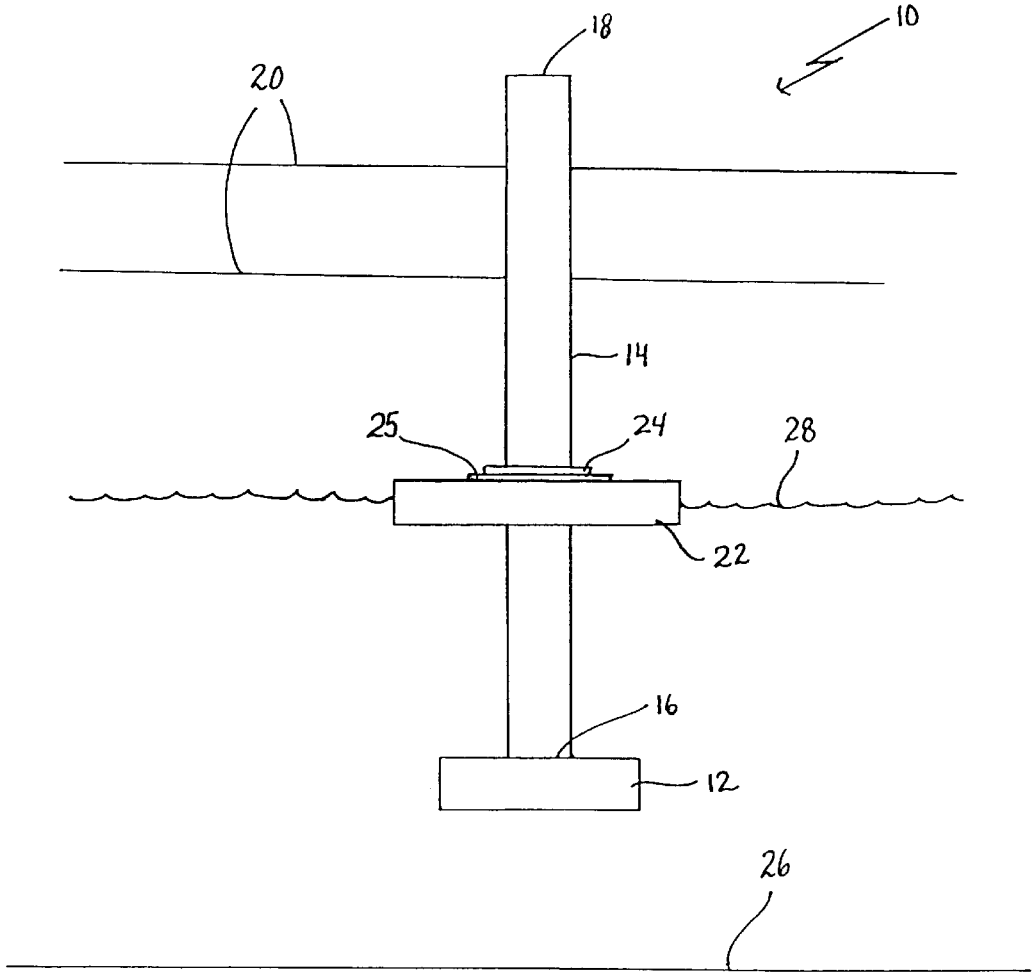
FIG. 3 is a side elevation view of the fence post illustrated in FIG. 1, when the water level is at its maximum level.

Fence post 10 also has a float 22 that is movable up and down vertical member 14 from first end 16 to second end 18 as illustrated in FIGS. 2 and 3.

Referring to FIG. 1, a stop 24 is spaced from first end 16 of fence post 10 so as to limit travel of float 22 along vertical member 14. A washer 25 is positioned between stop 24 and float 22. Washer 25 is made from a material to protect float, such as a hard plastic, aluminum, stainless steel or rubber.

Operation:

During the dry season, weighted base 12 of fence post 10 rests upon the ground 26. As the water level 28 rises due to a rain or spring run off, float 22 starts to rise upward along vertical member 14 as illustrated in FIG. 1. Float 22 will continue to rise with increasing water level 28 until float 22 reaches stop 24 as illustrated in FIG. 2. Washer 25 serves to prevent damage to float 22 from stop 24 float 22 bounced up and down in the water. Without washer 25 stop would wear into float 22 over time, or float 22 would have to be made of a harder material. If water 28 continues to rise after float 22 reaches stop 24, fence post 10 is then lifted off the ground by float 22 as illustrated in FIG. 3. In this manner, second end 18 of fence post 10 always kept above water level 28.

Weighted base 12 keeps fence post 10 in a stable upright condition when floating so fence post 10 does not tip over. When water level 28 recedes, weighted base 12 of fence post 10 is set back down onto ground 26 as shown in FIG. 1. As water level 28 continues to recede, float 22 moves axially back down toward first end 16 of vertical member 14.

When fence post 10 is installed, wires 20 may be attached to second end 18 of fence post 10 as illustrated in FIG. 1, which can extend to adjacent fence posts.

Variations and Alternative Embodiments:

Although concrete has been found to be an inexpensive and effective material out of which weighted base 12 can be made, there are other materials that would provide the necessary weight, such as steel or lead weights.

Although recycled polymer plastic is preferred for vertical members 14, because markets are being sought for recycled polymer plastic and it will not rot; there are other materials that would also work. Wooden posts can be used, as long as they have been properly treated with a wood preservative. Other materials include steel and fiberglass.

Cautionary Warnings:

When fence post 10 is floating as illustrated in FIG. 3, weighted base 12 should be positioned low enough to keep vertical member 14 in a stable upright condition. Stop 24 for float 22 should, therefore, be positioned with a view to positioning float 22 to maintain this stable upright condition.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A fence post, comprising:

a weighted base;

a vertical member having a first end and a second end, the first end being secured to and extending substantially vertically from the weighted base;

a float that is axially movable along the vertical member from the first end toward the second end; and a stop spaced from the first end thereby limiting travel of the float along the vertical member, the distance between the stop and the weighted base being selected to maintain the vertical member in a stable upright condition when floating.

2. The fence post as defined in claim 1, wherein the weighted base is concrete.

3. The fence post as defined in claim 1, wherein the vertical member is water resistant.

4. The fence post as defined in claim 3, wherein the vertical member is made from polymer plastic.

5. A fence post, comprising:

a weighted concrete base;

a polymer plastic vertical member having a first end and a second end, the first end being secured to and extending substantially vertically from the weighted base;

a float that is axially movable along the vertical member from the first end toward the second end; and a stop spaced from the first end, thereby limiting travel of the float along the vertical member, the distance between the stop and the weighted base being such that the vertical member is maintained in a stable upright condition when floating.

* * * * *